US008844783B2

(12) United States Patent
Tan

(10) Patent No.: US 8,844,783 B2
(45) Date of Patent: Sep. 30, 2014

(54) VERTICAL CORE SLOT DISPENSER AND ADAPTER FOR A BIN

(71) Applicant: Daniel Brian Tan, Harahan, LA (US)

(72) Inventor: Daniel Brian Tan, Harahan, LA (US)

( * ) Notice: Subject to any disclaimer, the term of this patent is extended or adjusted under 35 U.S.C. 154(b) by 0 days.

(21) Appl. No.: 13/687,994

(22) Filed: Nov. 28, 2012

(65) Prior Publication Data

US 2014/0144966 A1 May 29, 2014

Related U.S. Application Data

(63) Continuation of application No. PCT/US2012/022229, filed on Jan. 23, 2012.

(51) Int. Cl.
*B26F 3/02* (2006.01)
*B65H 35/04* (2006.01)

(52) U.S. Cl.
CPC ..... *B26F 3/02* (2013.01)
USPC ..... 225/46; 225/106

(58) Field of Classification Search
CPC ..... B65H 16/06; B65H 16/02; B65H 35/10; B26F 3/02; A47K 10/32
USPC ..... 225/46, 47, 52, 53, 54, 88, 93, 106, 39; 242/598.3, 599.3, 598, 600; 83/649, 83/659, 949
See application file for complete search history.

(56) References Cited

U.S. PATENT DOCUMENTS 1,745,771 A * 2/1930 Sherwood ..... 242/595
2,304,312 A * 12/1942 Meglitz ..... 225/47
3,272,346 A 9/1966 Michaud
4,362,278 A 12/1982 Hopkinson
5,219,424 A * 6/1993 Simhaee ..... 225/47
RE34,856 E 2/1995 Daniels
5,556,019 A * 9/1996 Morris ..... 225/96
5,558,262 A * 9/1996 Simhaee ..... 225/106
5,921,390 A 7/1999 Simhaee
5,934,535 A 8/1999 Kannankeril et al.
6,267,322 B1 * 7/2001 Harmathy ..... 242/595
6,305,572 B1 10/2001 Daniels et al.
6,481,594 B1 11/2002 Yeh et al.
6,561,403 B1 5/2003 Kannankeril et al.
7,128,251 B1 10/2006 Galle (Continued)

FOREIGN PATENT DOCUMENTS

CA 2246869 A1 * 3/2000
WO WO 9603338 A2 * 2/1996

*Primary Examiner* — Boyer D Ashley
*Assistant Examiner* — Jennifer Swinney
(74) *Attorney, Agent, or Firm* — David A. Belasco; Belasco Jacobs & Townsley, LLP

(57) ABSTRACT

A vertical core slot dispenser supports a roll of film bags wound on a hollow central core. An adapter for a bin provides mounting for at least one of the dispensers. An optional bracket has fixtures to connect lower portions of the platforms to a mounting system. A core pin has first and second ends, fits slidably within the central core and has at least one notch that extends across one of the ends. First and second guide slots are sized, shaped and located to fit slidably about the first and second ends of the core pin. At least one guide rail is located between outer edges of the guide slots. The rail is sized and shaped to slidably engage and retain the at least one notch in the core pin. At least one bag stream guide, pair of side constraints and snagging hook are attached to the bag dispenser.

24 Claims, 6 Drawing Sheets

(56) References Cited

U.S. PATENT DOCUMENTS

| | | | | |
|---|---|---|---|---|
| 7,552,842 | B1 | 6/2009 | Carvajal | |
| 7,624,881 | B2 | 12/2009 | Wilfong, Jr. | |
| 8,251,270 | B2 | 8/2012 | Tseng | |
| 2002/0160896 | A1 | 10/2002 | Yeh et al. | |
| 2002/0170937 | A1 | 11/2002 | Yeh et al. | |
| 2003/0098326 | A1 | 5/2003 | Wile | |
| 2005/0035135 | A1 | 2/2005 | Sasian | |
| 2011/0215128 | A1 | 9/2011 | Greg | |
| 2012/0125970 | A1* | 5/2012 | Tsui | 225/106 |
| 2012/0305618 | A1* | 12/2012 | Tan | 225/47 |
| 2012/0305619 | A1* | 12/2012 | Tan | 225/106 |

* cited by examiner

VERTICAL CORE SLOT DISPENSER AND ADAPTER FOR A BIN

RELATED APPLICATION

The instant application is a continuation of PCT/US2012/022229 filed Jan. 23, 2012 and claims priority to the filing date thereof.

FIELD OF INVENTION

This invention relates to the field of dispensing systems for plastic and other film bags and more specifically to dispensers for roll mounted bags.

BACKGROUND OF THE INVENTION

As mounting space is usually at a premium in supermarkets and grocery stores, it is desirable to have bag dispensing systems that use a minimum of such space, are adaptable to a variety of dispenser mounting systems and provide means for keeping bags neat and orderly in the store. Roll mounted bag systems, typically used for fresh produce, can help with limited space problems when they are designed to use folded bags. These relatively large bags are folded two to four times along vertical axes and then formed into compact rolls. The bags are typically joined to one another using perforations. Some bags, known as star-sealed bags are folded twice and then sealed across their bottom edges. This produces a bag with an extremely strong bottom.

When using roll mounted bags, it is critical that the bags are correctly loaded into the bag dispenser and that the bag roll cannot accidently leave the dispenser when a user attempts to pull a bag from the roll. Should this happen, the bag roll could end up on the floor of store, providing a potentially hazardous condition. Dispensers for roll mounted bags should ideally provide a means to insure that the bag roll will remain in the dispenser. Some examples of dispensers for roll mounted bags and related inventions include the following.

U.S. Pat. No. 6,481,594, issued to Yeh et al., is directed to a roll mounted T-shirt style produce bag and dispensers for same. The wire frame structure dispenser has slots that are perpendicular to the bottom portion of the attachment member which in turn is parallel to the supporting base. The bottom portion of attachment member may be attached to a horizontal surface. The roll of bags is mounted on a cylindrical core which fits into the slots.

U.S. Pat. No. 5,219,424, issued to Simhaee is directed to a roll of plastic bags for use with a bag dispensing device. The dispenser is substantially a rectangular box with an open top that is open for quick replacement of the bag roll. The bottom of the dispenser rests on a flat surface with mounting grooves perpendicular to the flat surface. The roll is mounted on an axle to mount into the grooves of the sidewalls of the box. The grooves extend to the top of the sidewalls. One end of the axle has notches corresponding to the groove which is narrowed in order to prevent rotation of the axle during rotation of the roll about the axle. The bags are dispensed over the top surface of the end wall of the box.

U.S. Pat. No. RE34,856, issued to Daniels illustrates a method and apparatus for dispensing merchandise bags. The dispenser shown is a wire frame structure with a pair of mounting plates and a roll mounting cradle provided to receive a bag roll. The cradle is formed of a U-shaped member and may be swung into operating position from an open position. When the cradle is in the dispensing position, the axis of rotation of the roll is parallel to a mounting axle or the axis of rotation of the roll without an axle. Thus, the cradle that holds the roll in position corresponds to mounting slots if an axle were present and the orientation of this cradle would be perpendicular to the mounting plates.

U.S. Pat. No. 7,552,842, issued to Carvajal is directed to a trash bag dispenser with a roll of trash bag material mounted on a support rod which is received into V-notch shaped receiving areas. The roll would be mounted into notches which correspond to that are perpendicular to the mounting surface.

U.S. Pat. No. 6,561,403, issued to Kannankeril et al. is directed to a bag separator and dispenser for plastic bags mounted on a roll and supported by a core.

U.S. Pat. No. 6,488,222, issued to West et al. discloses a dispensing system that utilizes a roll of folded-gusseted bags in combination with a dispenser comprising: (i) a support member for attachment to a support surface; (ii) a pair of guide channels carried by the support member for rotatably supporting the roll of plastic bags for rotation of the roll on the core; (iii) a tongue spaced apart from and carried by the support member in a predetermined position corresponding to the predetermined position of the slit in the tear line.

U.S. Pat. No. 5,934,535, issued to Kannankeril et al. discloses a bag dispensing system providing plastic bags from a roll of bags where one end is attached to the top of the next bag by perforation lines with a slot there between. The roll of bags provides a core having an indexing member on at least one end. The dispenser comprising a wire frame formed into channels to support the core. The channels include a core retaining member for restraining the core in the channel. The dispenser includes at least one brake attached to a support member and disposed at an angle thereto to provide tension to the edges of the roll of bags as the core passes through the channel passageway as bags are removed from the roll.

It is an objective of the present invention to provide a bag dispensing system that accommodates large size film bags that are folded and provided as compact bag rolls. It is a further objective to provide a system that keeps the bag roll securely within the dispenser at all times. It is a still further objective of the invention to provide a dispensing system adaptable to a variety of different mountings. It is yet a further objective to provide such a system that provides a visual indication of the need to refill the dispenser. It is another objective of the invention to provide a dispenser that can dispense bags from either the front side or the back side of the dispenser. Finally, it is an objective of the present invention to provide a bag dispensing system that is durable, inexpensive, easy to keep clean and simple to use.

While some of the objectives of the present invention are disclosed in the prior art, none of the inventions found include all of the requirements identified.

SUMMARY OF THE INVENTION

The present invention addresses all of the deficiencies of prior art dispensers for roll mounted film bags and satisfies all of the objectives described above.

(1) A vertical core slot dispenser providing the desired features may be constructed from the following components. First and second angled platforms are provided. The platforms are sized and shaped to support a roll of film bags wound on a hollow central core. A core pin is provided. The core pin has first and second ends, is sized and shaped to fit slidably within the central core. First and second guide slots are provided. The slots are sized, shaped and located to fit slidably about the first and second ends of the core pin.

(2) In a variant of the invention, a bracket is provided. The bracket has fixtures for attachment to lower portions of the angled platforms and is adapted to connect to at least one mounting system.

(3) In another variant, The core pin has at least one notch. The notch extends across one of the ends.

(4) In still another variant, at least one guide rail is provided. The guide rail is located between outer edges of at least one of the first and second guide slots and is sized and shaped to slidably engage the at least one notch in the core pin.

(5) In yet another variant, first and second front side constraints are provided. The front side constraints are located orthogonally to the first and second angled platforms, in front of the first and second guide slots. The front side constraints are spaced apart by at least the width of the roll of film bags.

(6) In another variant, first and second rear side constraints are provided. The rear side constraints are located orthogonally to the first and second angled platforms, behind the first and second guide slots. The rear side constraints are spaced apart by at least the width of the roll of film bags.

(7) In still another variant, at least one bag stream guide is provided. The bag stream guide is located orthogonally to at least one of the first and second angled platforms at at least one of a front end or a rear end of the dispenser. The guide provides at least one pathway for a bag stream coming from the bag roll.

(8) In yet another variant, a bag roll constraining barrier is provided. The barrier is located orthogonally to one of the first and second angled platforms at either a front end or a rear end of the dispenser. The barrier provides a guide for inserting the roll into the dispenser.

(9) In a further variant, the first and second guide slots are orthogonal to the bracket.

(10) In still a further variant, an upward facing snagging hook is provided. The snagging hook is located adjacent a lower end of the first angled platform.

(11) In yet a further variant, a second upward facing snagging hook is provided. The second snagging hook is located adjacent a lower end of the second angled platform.

(12) In another variant of the invention, at least one guide slot retainer is provided. The retainer is located at an upper end of at least one of the first and second guide slots. The retainer prevents unwanted removal of the roll of film bags from the dispenser.

(13) In still another variant, the bracket is attached to a mounting system attached to either a vertical surface, a horizontal surface, or an angled surface.

(14) In yet another variant, a security link is provided. The link flexibly attaches the core pin to the dispenser so as to prevent loss of the pin.

(15) In a further variant, the security link is selected from the group includes chain, wire, string, cord or flexible plastic rod.

(16) In still a further variant, an adapter for a bin is provided. The bin includes a support enclosure for a roll of film bags. The enclosure has a half round cylindrical wall, first and second vertical side walls. A supporting rim is provided. The rim is located orthogonally to front edges of the side walls and to upper and lower edges of the cylindrical wall. The rim has spaced apertures for mounting the bin to a surface. The surface has an opening sized and shaped to permit passage of outer surfaces of the walls but not the supporting rim. The vertical side walls have first and second integral channels. The channels provide an entry point and support for a rod. The rod is sized and shaped to support the roll of bags in the channels.

The adapter includes a fixture. The fixture includes a planar surface. The surface is sized and shaped to fit at least partially within the bin. At least one vertical core slot bag dispenser for folded roll mounted film bags is provided. The dispenser includes a planar base. The base is sized and shaped to fit beneath a roll of the film bags and is mounted to the fixture. First and second angled platforms are provided. The platforms are sized and shaped to support a roll of film bags wound on a hollow central core. A core pin is provided. The core pin has first and second ends, is sized and shaped to fit slidably within the central core. First and second guide slots are provided. The slots are sized, shaped and located to fit slidably about the first and second ends of the core pin.

A first axle is provided. The first axle is mounted orthogonally adjacent a first side edge of the fixture. A second axle is provided. The second axle is mounted orthogonally adjacent a second side edge of the fixture. The first axle is mounted coaxially with the second axle. First and second positioning wheels are provided. The positioning wheels are mounted to the first and second axles and located to slidably engage the first and second integral channels with a bottom surface of the fixture located adjacent a lower portion of the cylindrical wall of the enclosure.

(17) In yet a further variant, the at least one vertical core slot dispenser further includes at least one aperture penetrating the planar base for mounting the base to the fixture.

(18) In still another variant, the core pin further includes at least one notch. The notch extends across one of the ends.

(19) In yet another variant, the at least one vertical core slot dispenser further includes at least one guide rail. The guide rail is located between outer edges of at least one of the first and second guide slots and is sized and shaped to slidably engage the at least one notch in the core pin.

(20) In a further variant, the at least one vertical core slot dispenser further includes first and second front side constraints. The front side constraints are located orthogonally to the first and second angled platforms, in front of the first and second guide slots and spaced apart by at least the width of the roll of film bags.

(21) In still a further variant, the at least one vertical core slot dispenser further includes first and second rear side constraints. The rear side constraints are located orthogonally to the first and second angled platforms, behind the first and second guide slots and spaced apart by at least the width of the roll of film bags.

(22) In yet a further variant, the at least one vertical core slot dispenser further includes a bag stream guide. The bag stream guide is located orthogonally to the first angled platform at a front end of the dispenser. The guide provides a pathway for a bag stream coming from the bag roll.

(23) In another variant of the invention, the at least one vertical core slot dispenser further includes a bag roll constraining barrier. The barrier is located orthogonally to one of the first and second angled platforms at either of a front end and a rear end of the dispenser. The barrier provides a guide for inserting the roll into the dispenser.

(24) In still another variant, the first and second guide slots of the at least one vertical core slot dispenser are orthogonal to the planar base.

(25) In yet another variant, the at least one vertical core slot dispenser further includes an upward facing snagging hook. The snagging hook is located adjacent a lower end of the first angled platform.

(26) In a further variant, the at least one vertical core slot dispenser further includes at least one guide slot retainer. The retainer is located at an upper end of at least one of the first and second guide slots. The retainer prevents unwanted removal of the roll of film bags from the dispenser.

(27) In still a further variant, the at least one vertical core slot dispenser further includes a security link. The link flexibly attaches the core pin to the dispenser so as to prevent loss of the pin.

(28) In a final variant, the security link is selected from the group that includes chain, wire, string, cord or flexible plastic rod.

An appreciation of the other aims and objectives of the present invention and an understanding of it may be achieved by referring to the accompanying drawings and the detailed description of a preferred embodiment.

DESCRIPTION OF THE DRAWINGS

DETAILED DESCRIPTION OF THE PREFERRED EMBODIMENT (1) FIGS. 1-4 illustrate a vertical core slot dispenser 10 providing the desired features that may be constructed from the following components. First 14 and second 18 angled platforms are provided. The platforms 14, 18 are sized and shaped to support a roll 22 of film bags 26 wound on a hollow central core 30. As illustrated in FIG. 2, a core pin 50 is provided. The core pin 50 has first 54 and second 58 ends, is sized and shaped to fit slidably within the central core 30. at least one notch 62. The notch 62 extends across one of the ends 54, 58. As illustrated in FIG. 1, first 66 and second 70 guide slots are provided. The slots 66, 70 are sized, shaped and located to fit slidably about the first 54 and second 58 ends of the core pin 50. At least one guide rail 74 is provided. The guide rail 74 is located between outer edges 78 of at least one of the first 66 and second 70 guide slots and is sized and shaped to slidably engage the at least one notch 62 in the core pin 50.

Figure 1:
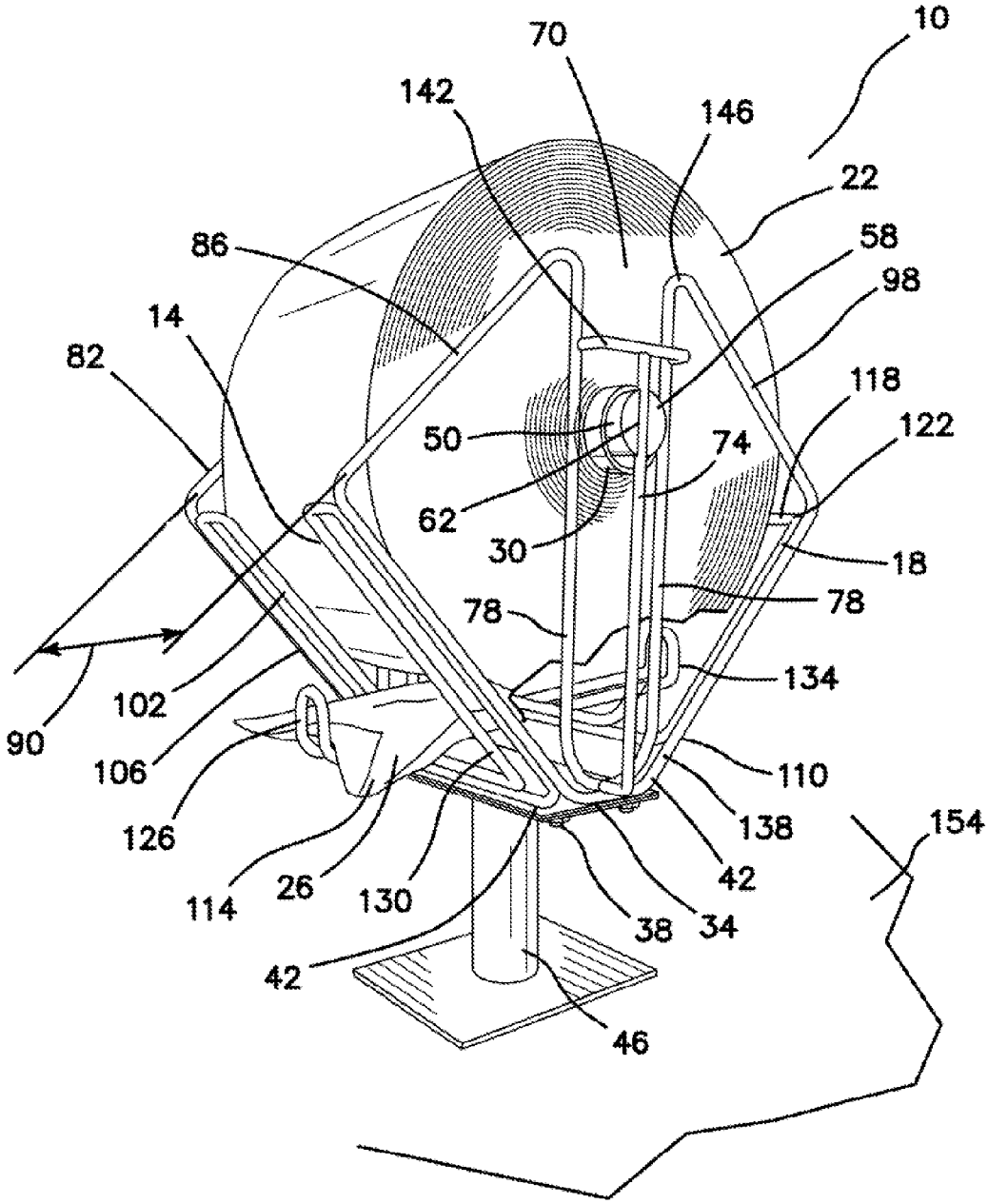
FIG. 1 is a perspective view of the preferred embodiment of the invention illustrating a roll of film bags in place in the dispenser which is attached to a horizontal surface.

(2) In a variant of the invention, a bracket 34 is provided. The bracket 34 has fixtures 38 for attachment to lower portions 42 of the angled platforms 14, 18 and is adapted to connect to at least one mounting system 46.

(3) In another variant, the core pin 50 has at least one notch 62. The notch 62 extends across one of the ends 54, 58.

(4) In still another variant, at least one guide rail 74 is provided. The guide rail 74 is located between outer edges 78 of at least one of the first 66 and second 70 guide slots and is sized and shaped to slidably engage the at least one notch 62 in the core pin 50.

(5) In a variant of the invention, first 82 and second 86 front side constraints are provided. The front side constraints 82, 86 are located orthogonally to the first 14 and second 18 angled platforms, in front of the first 66 and second 70 guide slots. The front side constraints 82, 86 are spaced apart by at least the width 90 of the roll 22 of film bags 26.

(6) In another variant, first 94 and second 98 rear side constraints are provided. The rear side constraints 94, 98 are located orthogonally to the first 14 and second 18 angled platforms, behind the first 66 and second 70 guide slots. The rear side constraints 94, 98 are spaced apart by at least the width 90 of the roll 22 of film bags 26.

(7) In still another variant, at least one bag stream guide 102 is provided. The bag stream guide 102 is located orthogonally to at least one of the first 14 and second 18 angled platforms at at least one of a front end 106 or a rear end 110 of the dispenser 10. The guide 102 provides at least one pathway for a bag stream 114 coming from the bag roll 22.

(8) In yet another variant, a bag roll constraining barrier 118 is provided. The barrier 118 is located orthogonally to one of the first 14 and second 18 angled platforms at either a front end 106 or a rear end 110 of the dispenser 10. The barrier 118 provides a guide 122 for inserting the roll 22 into the dispenser 10.

(9) In a further variant, the first 66 and second 70 guide slots are orthogonal to the bracket 34.

(10) In still a further variant, an upward facing snagging hook 126 is provided. The snagging hook 126 is located adjacent a lower end 130 of the first angled platform 14.

Figure 3:
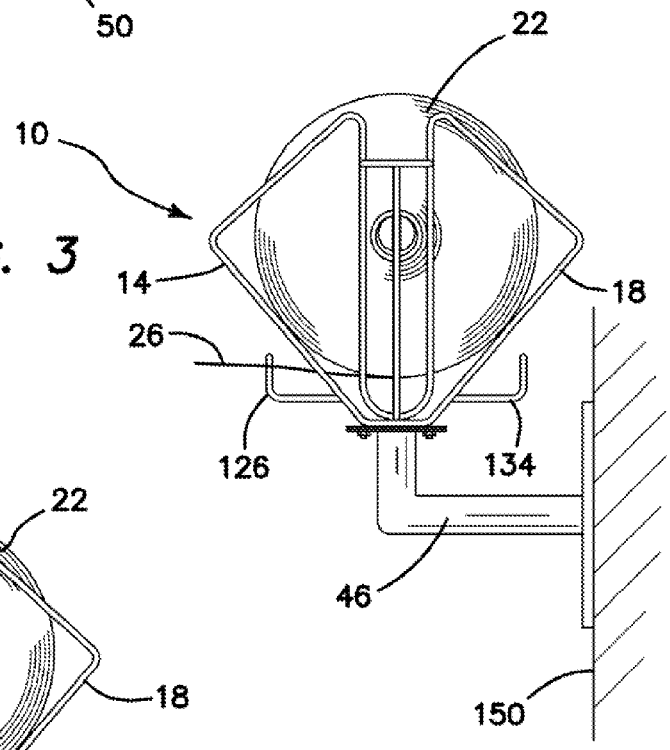
FIG. 3 is a side elevational view of the FIG. 1 embodiment attached to a vertical surface.
Figure 4:
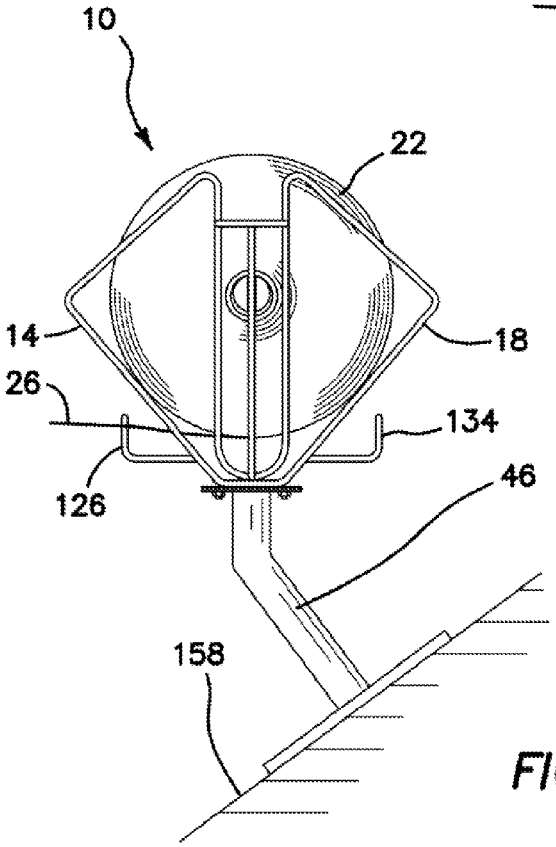
FIG. 4 is a side elevational view of the FIG. 1 embodiment attached to an angled surface.

(11) In yet a further variant, as illustrated in FIGS. 1, 3 and 4, a second upward facing snagging hook 134 is provided. The second snagging hook 134 is located adjacent a lower end 138 of the second angled platform 18.

(12) In another variant of the invention, at least one guide slot retainer 142 is provided. The retainer 142 is located at an upper end 146 of at least one of the first 66 and second 70 guide slots. The retainer 142 prevents unwanted removal of the roll 22 of film bags 26 from the dispenser 10.

(13) In still another variant, the bracket 34 is attached to a mounting system 46 attached to either of a vertical surface 150, a horizontal surface 154, or an angled surface 158.

Figure 2:
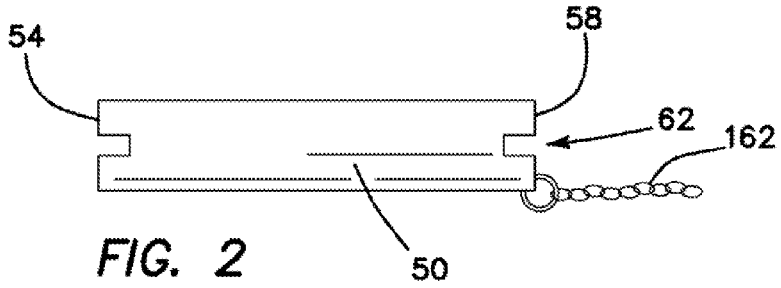
FIG. 2 is a side elevational view of a core pin with attached security link for use with the FIG. 1 embodiment.
Figure 5:
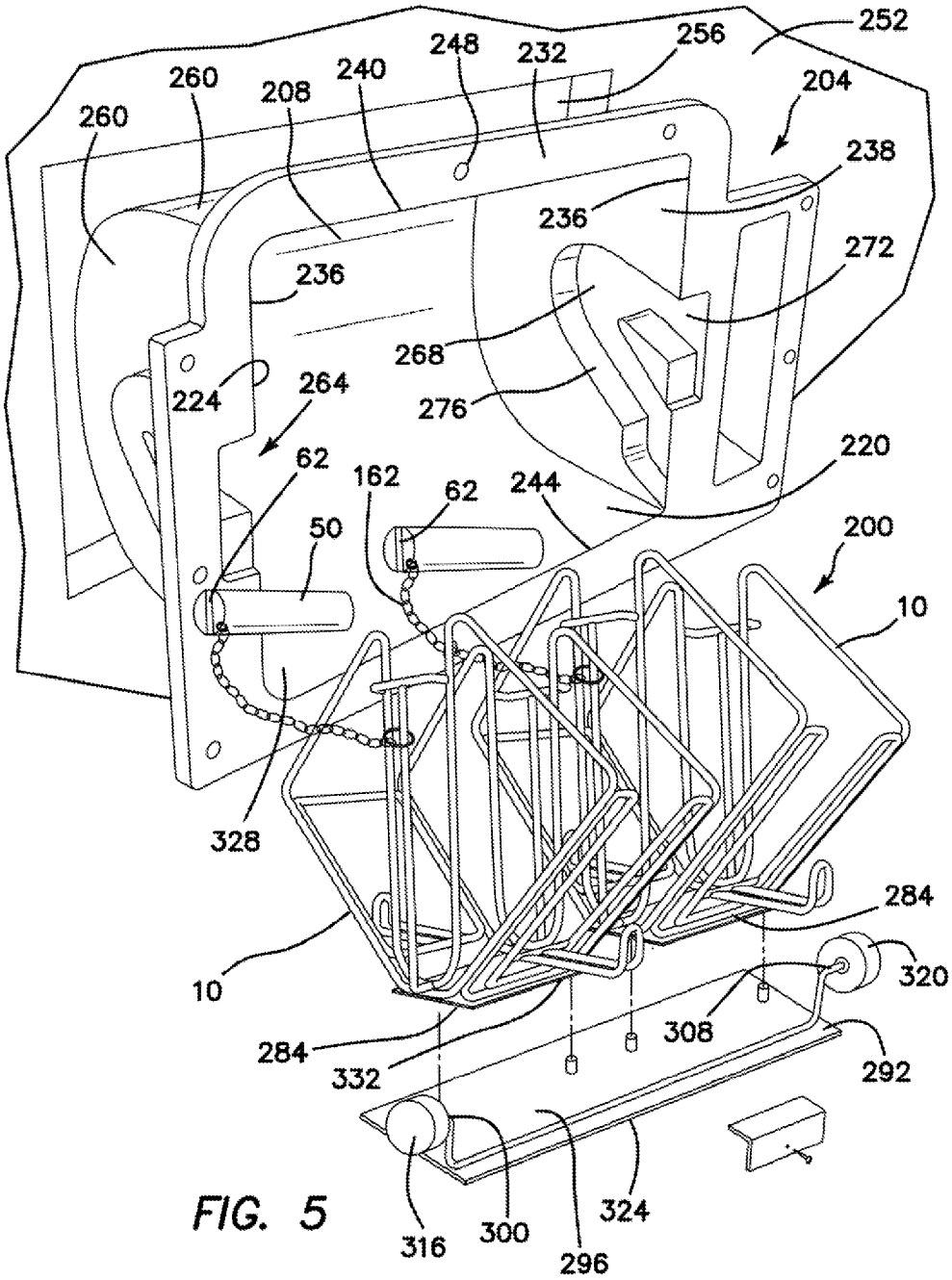
FIG. 5 is a perspective exploded view of an adapter for a bin with two of the FIG. 1 dispensers and the bin.
Figure 6:
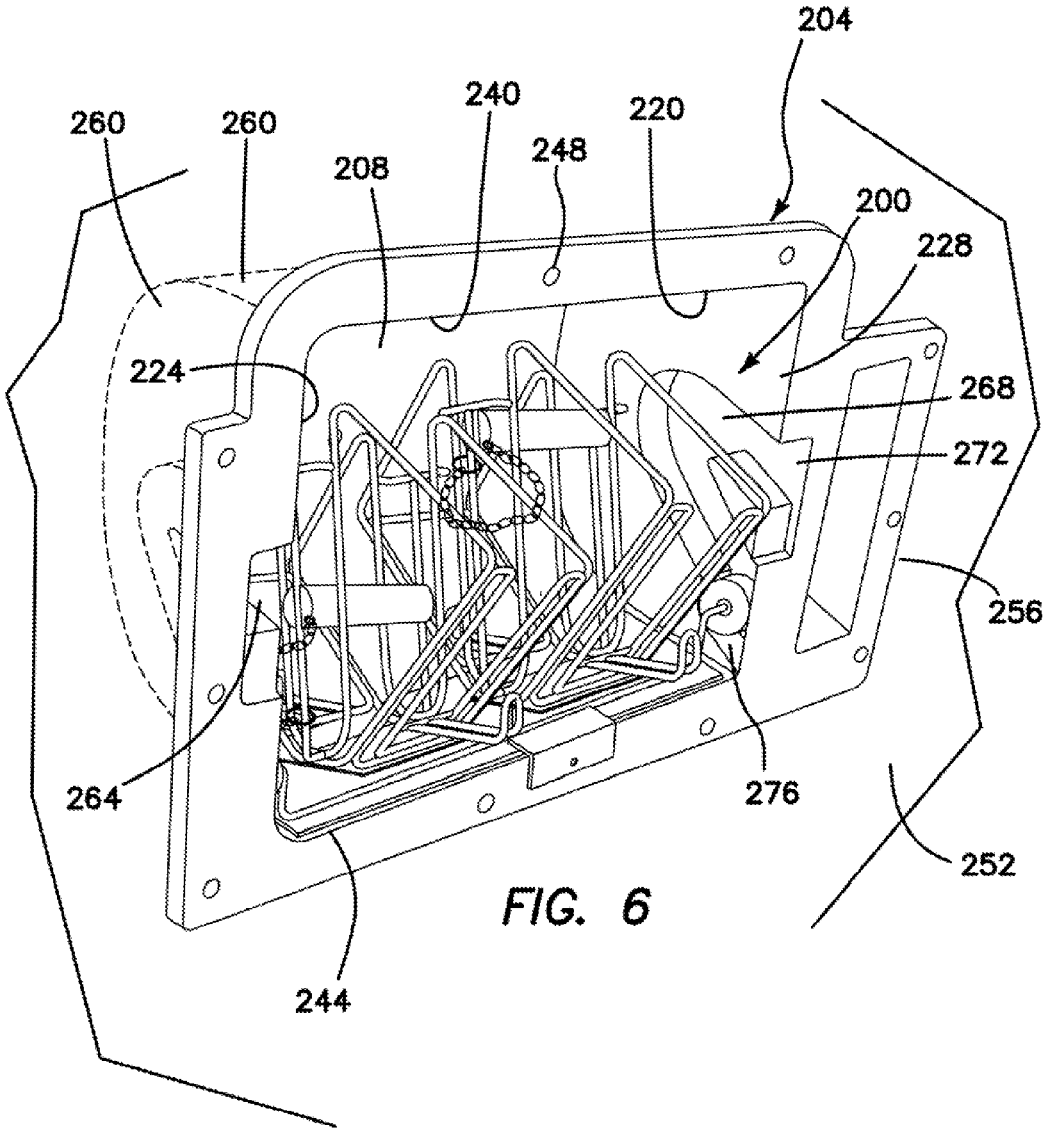
FIG. 6 is an assembled perspective view of the FIG. 5 embodiment.
Figure 7A:
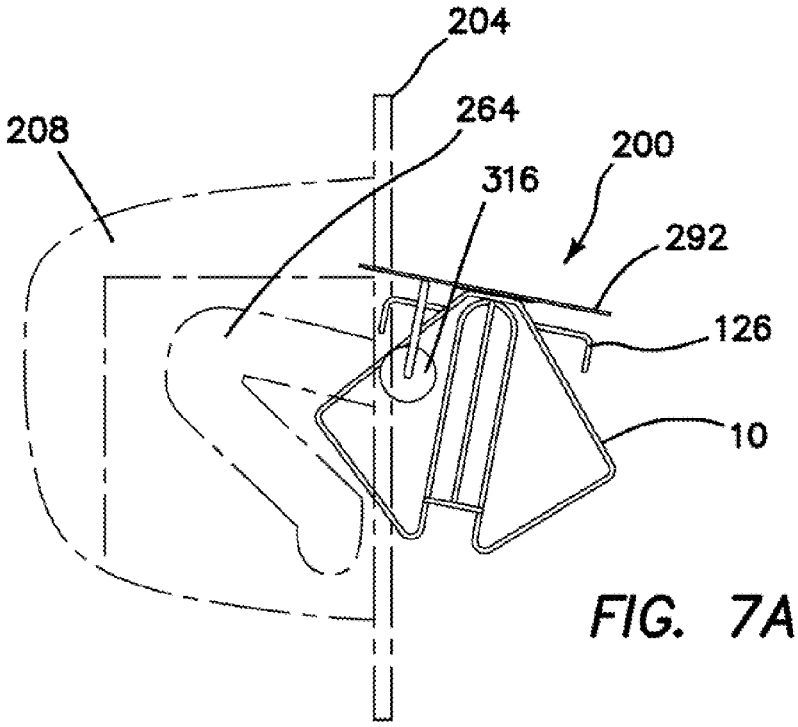
FIGS. 7A-7D are side elevational views of the installation of the FIG. 5 embodiment being installed into the bin.
Figure 7B:
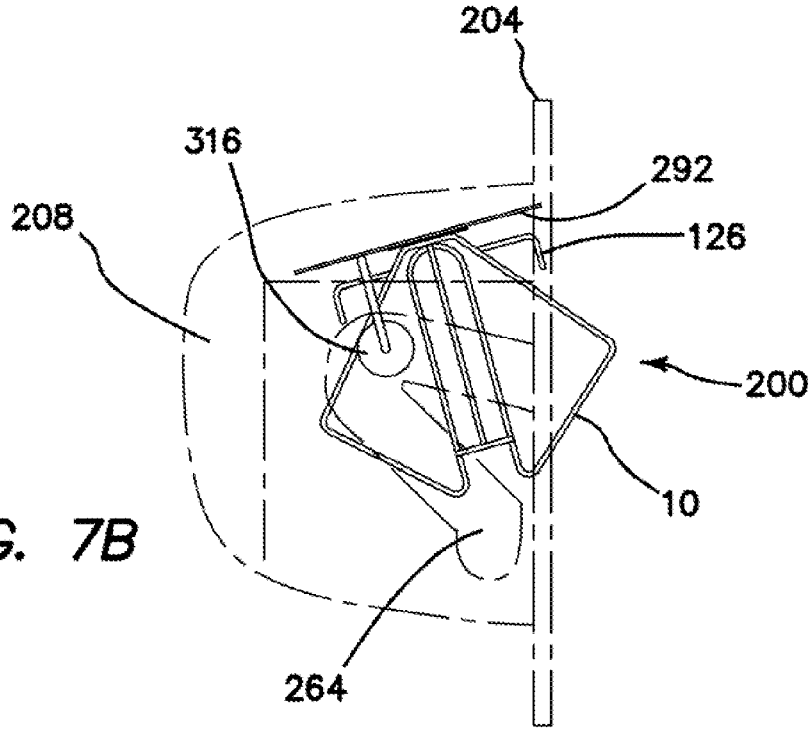
Figure 7C:
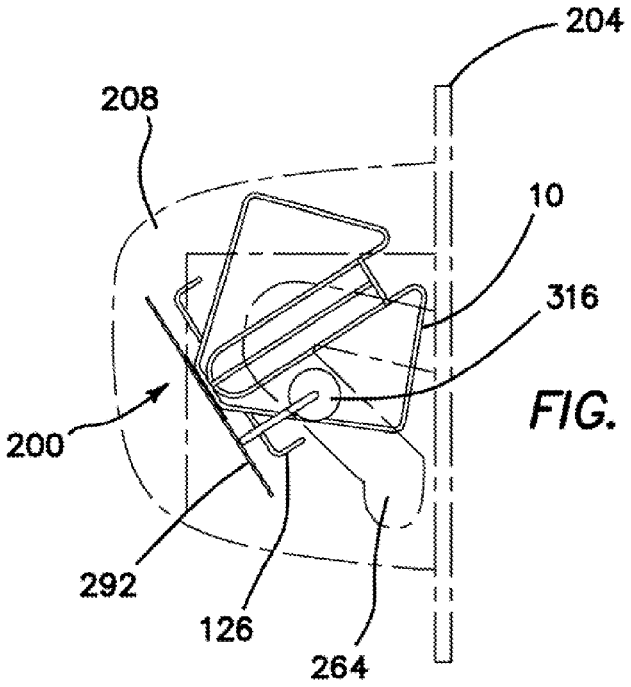
Figure 7D:
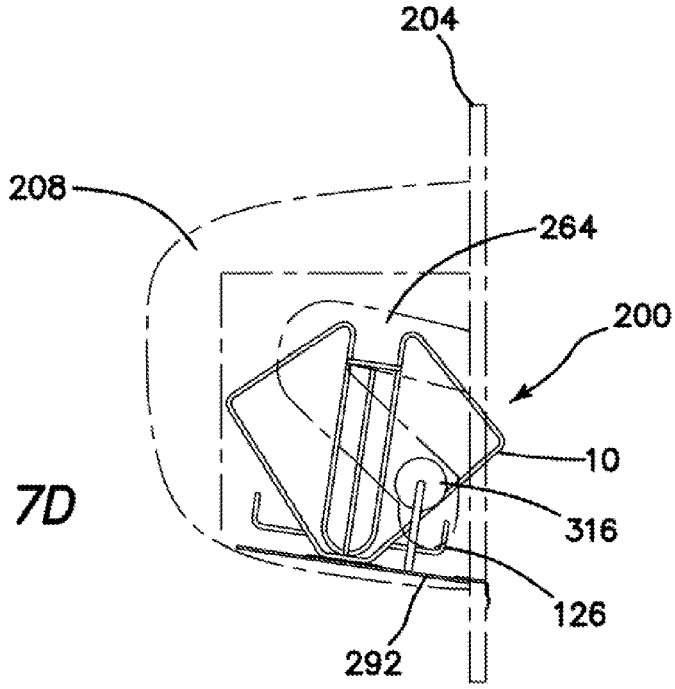

(14) In yet another variant, as illustrated in FIGS. 2, 5 and 6, a security link 162 is provided. The link 162 flexibly attaches the core pin 50 to the dispenser 10 so as to prevent loss of the pin 50.

(15) In a further variant, the security link 162 is selected from the group includes chain 166, wire (not shown), string (not shown), cord (not shown) or flexible plastic rod (not shown).

(16) In still a further variant, as illustrated in FIGS. 1-4, 5, 6 and 7A-7D, an adapter for a bin 200 is provided. The bin 204 includes a support enclosure 208 for a roll 30 of film bags 26. The enclosure 208 has a half round cylindrical wall 220, first 224 and second 228 vertical side walls. A supporting rim 232 is provided. The rim 232 is located orthogonally to front edges 236 of the side walls 224, 228 and to upper 240 and lower 244 edges of the cylindrical wall 220. The rim 232 has spaced apertures 248 for mounting the bin 204 to a surface 252. The surface 252 has an opening 256 sized and shaped to permit passage of outer surfaces 260 of the walls 224, 228, and 220 but not the supporting rim 232. The vertical side walls 224, 228 have first 264 and second 268 integral channels. The channels 264, 268 provide an entry point 272 and support 276 for a rod (not shown). The rod is sized and shaped to support the roll 212 of bags 216 in the channels 264, 268.

The adapter 200 includes a fixture 292. The fixture 292 includes a planar surface 296. The surface 296 is sized and shaped to fit at least partially within the bin 204. At least one vertical core slot bag dispenser 10 for folded roll mounted film bags 26 is provided. The dispenser 10 includes a planar base 284. The base 284 is sized and shaped to fit beneath a roll 22 of the film bags 26 and is mounted to the fixture 292. First 14 and second 18 angled platforms are provided. The platforms 14, 18 are sized and shaped to support a roll of film bags 26 wound on a hollow central core 30. A core pin 50 is provided. The core pin 50 has first 54 and second 58 ends, is sized and shaped to fit slidably within the central core 30. First 66 and second 70 guide slots are provided. The slots 66, 70 are sized, shaped and located to fit slidably about the first 54 and second 58 ends of the core pin 50.

A first axle 300 is provided. The first axle 300 is mounted orthogonally adjacent a first side edge 304 of the fixture 292. A second axle 308 is provided. The second axle 308 is mounted orthogonally adjacent a second side edge 312 of the fixture 292. The first axle 300 is mounted coaxially with the second axle 308. First 316 and second 320 positioning wheels are provided. The positioning wheels 316, 320 are mounted to the first 300 and second 308 axles and located to slidably engage the first 264 and second 268 integral channels with a bottom surface 324 of the fixture 292 located adjacent a lower portion 328 of the cylindrical wall 220 of the enclosure 208.

(17) In yet a further variant, the at least one vertical core slot dispenser 10 further includes at least one aperture 332 penetrating the planar base 284 for mounting the base 284 to the fixture 292.

(18) In still another variant, the core pin 50 further includes at least one notch 62. The notch 62 extends across one of the ends 54, 58.

(19) In yet another variant, the at least one vertical core slot dispenser 10 further includes at least one guide rail 74. The guide rail 74 is located between outer edges 78 of at least one of the first 66 and second 70 guide slots and is sized and shaped to slidably engage the at least one notch 62 in the core pin 50.

(20) In a further variant, the at least one vertical core slot dispenser 10 further includes first 82 and second 86 front side constraints. The front side constraints 82, 86 are located orthogonally to the first 14 and second 18 angled platforms, in front of the first 66 and second 70 guide slots. The front side constraints 82, 86 are spaced apart by at least the width 90 of the roll 22 of film bags 26.

(21) In still a further variant, the at least one vertical core slot dispenser 10 further includes first 94 and second 98 rear side constraints. The rear side constraints 94, 98 are located orthogonally to the first 14 and second 18 angled platforms, behind the first 66 and second 70 guide slots. The rear side constraints 94, 98 are spaced apart by at least the width 90 of the roll 22 of film bags 26.

(22) In yet a further variant, the at least one vertical core slot dispenser 10 further includes a bag stream guide 102. The bag stream guide 102 is located orthogonally to at least one of the first 14 and second 18 angled platforms at at least one of a front end 106 or a rear end 110 of the dispenser 10. The guide 102 provides at least one pathway for a bag stream 114 coming from the bag roll 22.

(23) In another variant of the invention, the at least one vertical core slot dispenser 10 further includes a bag roll constraining barrier 118. The barrier 118 is located orthogonally to one of the first 14 and second 18 angled platforms at either a front end 106 or a rear end 110 of the dispenser 10. The barrier 118 provides a guide 122 for inserting the roll 22 into the dispenser 10.

(24) In still another variant, the first 66 and second 70 guide slots of the at least one vertical core slot dispenser 10 are orthogonal to the planar base 284.

(25) In yet another variant, the at least one vertical core slot dispenser 10 further includes an upward facing snagging hook 126 is provided. The snagging hook 126 is located adjacent a lower end 130 of the first angled platform 14.

(26) In a further variant, the at least one vertical core slot dispenser 10 further includes at least one guide slot retainer 142 is provided. The retainer 142 is located at an upper end 146 of at least one of the first 66 and second 70 guide slots. The retainer 142 prevents unwanted removal of the roll 22 of film bags 26 from the dispenser 10.

(27) In still a further variant, the at least one vertical core slot dispenser 10 further includes a security link 162. The link 162 flexibly attaches the core pin 50 to the dispenser 10 so as to prevent loss of the pin 50.

(28) In a final variant, the security link 162 is selected from the group includes chain 166, wire (not shown), string (not shown), cord (not shown) or flexible plastic rod (not shown).

The angled core slot dispenser 10 has been described with reference to particular embodiments. Other modifications and enhancements can be made without departing from the spirit and scope of the claims that follow.

The invention claimed is:

1. A vertical core slot dispenser comprising:

first and second angled platforms, said platforms being sized and shaped to support a roll of film bags wound on a hollow central core;

a core pin, said core pin having first and second ends, being sized and shaped to fit slidably within said central core;

said core pin further comprises at least one notch, said notch extending across one of said ends;

first and second guide slots, said slots being sized, shaped and disposed to fit slidably about said first and second ends of said core pin; and at least one guide rail, said guide rail being disposed between outer edges of at least one of said first and second guide slots and being sized and shaped to slidably engage said at least one notch in said core pin.

2. The vertical core slot dispenser, as described in claim 1, further comprising a bracket, said bracket having fixtures for attachment to lower portions of said angled platforms and being adapted to connect to at least one mounting system.

3. The vertical core slot dispenser, as described in claim 1, further comprising first and second front side constraints, said front side constraints being disposed orthogonally to said first and second angled platforms, in front of said first and second guide slots and spaced apart by at least the width of said roll of film bags.

4. The vertical core slot dispenser, as described in claim 1, further comprising first and second rear side constraints, said rear side constraints being disposed orthogonally to said first and second angled platforms, behind said first and second guide slots and spaced apart by at least the width of said roll of film bags.

5. The vertical core slot dispenser, as described in claim 1, further comprising at least one bag stream guide, said bag stream guide being disposed orthogonally to at least one of said first and second angled platforms at at least one of a front end and a rear end of said dispenser, said guide providing at least one pathway for a bag stream coming from said bag roll.

6. The vertical core slot dispenser, as described in claim 1, further comprising a bag roll constraining barrier, said barrier being disposed orthogonally to one of said first and second angled platforms at either of a front end and a rear end of said dispenser, said barrier providing a guide for inserting said roll into said dispenser.

7. The vertical core slot dispenser, as described in claim 1, wherein said first and second guide slots are orthogonal to said bracket.

8. The vertical core slot dispenser, as described in claim 1, further comprising an upward facing snagging hook, said snagging hook being disposed adjacent a lower end of said first angled platform.

9. The vertical core slot dispenser, as described in claim 8, further comprising a second upward facing snagging hook, said second snagging hook being disposed adjacent a lower end of said second angled platform.

10. The vertical core slot dispenser, as described in claim 1, further comprising at least one guide slot retainer, said retainer being disposed at an upper end of at least one of said first and second guide slots, said retainer preventing unwanted removal of said roll of film bags from said dispenser.

11. The vertical core slot dispenser, as described in claim 1, wherein said bracket is attached to a mounting system attached to either of a vertical surface, a horizontal surface, and an angled surface.

12. The vertical core slot dispenser, as described in claim 1, further comprising a security link, said link flexibly attaching said core pin to said dispenser so as to prevent loss of said pin.

13. The vertical core slot dispenser, as described in claim 12, wherein said security link is selected from the group comprising:

chain, wire, string, cord or flexible plastic rod.

14. An adapter for a bin, said bin comprising:

a support enclosure for a roll of film bags, said enclosure having a half round cylindrical wall, first and second vertical side walls;

a supporting rim, said rim disposed orthogonally to front edges of said side walls and upper and lower edges of said cylindrical wall and having spaced apertures for mounting said bin to a surface;

said surface having an opening sized and shaped to permit passage of outer surfaces of said walls but not said supporting rim;

said vertical side walls having first and second integral channels, said channels providing an entry point and support for a rod, said rod being sized and shaped to support said roll of bags in said channels;

said adapter comprising:

a fixture, said fixture comprising a planar surface, said surface being sized and shaped to fit at least partially within said bin;

at least one vertical core slot bag dispenser for folded roll mounted film bags, said dispenser comprising:

a planar base, said base being sized and shaped to fit beneath a roll of said film bags and being mounted to said fixture;

first and second angled platforms, said platforms being sized and shaped to support a roll of film bags wound on a hollow central core;

a core pin, said core pin having first and second ends, being sized and shaped to fit slidably within said central core;

said core pin further comprises at least one notch, said notch extending across one of said ends;

first and second guide slots, said slots being sized, shaped and disposed to fit slidably about said first and second ends of said core pin;

at least one guide rail, said guide rail being disposed between outer edges of at least one of said first and second guide slots and being sized and shaped to slidably engage said at least one notch in said core pin;

a first axle, said first axle being mounted orthogonally adjacent a first side edge of said fixture;

a second axle, said second axle being mounted orthogonally adjacent a second side edge of said fixture;

said first axle being mounted coaxially with said second axle; and first and second positioning wheels, said positioning wheels being mounted to said first and second axles and disposed to slidably engage said first and second integral channels with a bottom surface of said fixture disposed adjacent a lower portion of said cylindrical wall of said enclosure.

15. The adapter for a bin, as described in claim 14, wherein said at least one vertical core slot dispenser further comprises at least one aperture penetrating said planar base for mounting said base to said fixture.

16. The adapter for a bin, as described in claim 14, wherein said at least one vertical core slot dispenser further comprises first and second front side constraints, said front side constraints being disposed orthogonally to said first and second angled platforms, in front of said first and second guide slots and spaced apart by at least the width of said roll of film bags.

17. The adapter for a bin, as described in claim 14, wherein said at least one vertical core slot dispenser further comprises first and second rear side constraints, said rear side constraints being disposed orthogonally to said first and second angled platforms, behind said first and second guide slots and spaced apart by at least the width of said roll of film bags.

18. The adapter for a bin, as described in claim 14, wherein said at least one vertical core slot dispenser further comprises a bag stream guide, said bag stream guide being disposed orthogonally to said first angled platform at a front end of said dispenser, said guide providing a pathway for a bag stream coming from said bag roll.

19. The adapter for a bin, as described in claim 14, wherein said at least one vertical core slot dispenser further comprises a bag roll constraining barrier, said barrier being disposed orthogonally to one of said first and second angled platforms at either of a front end and a rear end of said dispenser, said barrier providing a guide for inserting said roll into said dispenser.

20. The adapter for a bin, as described in claim 14, wherein said first and second guide slots of said at least one vertical core slot dispenser are orthogonal to said planar base.

21. The adapter for a bin, as described in claim 14, wherein said at least one vertical core slot dispenser further comprises an upward facing snagging hook, said snagging hook being disposed adjacent a lower end of said first angled platform.

22. The adapter for a bin, as described in claim 14, wherein said at least one vertical core slot dispenser further comprises at least one guide slot retainer, said retainer being disposed at an upper end of at least one of said first and second guide slots, said retainer preventing unwanted removal of said roll of film bags from said dispenser.

23. The adapter for a bin, as described in claim 14, wherein said at least one vertical core slot dispenser further comprises a security link, said link flexibly attaching said core pin to said dispenser so as to prevent loss of said pin.

24. The adapter for a bin, as described in claim 23 wherein said security link is selected from the group comprising:

chain, wire, string, cord or flexible plastic rod.

* * * * *